US005943764A

United States Patent [19]

Blecha et al.

[11] Patent Number: 5,943,764

[45] Date of Patent: Aug. 31, 1999

[54] METHOD OF MANUFACTURING A SURFACE-MOUNTED FUSE DEVICE

[75] Inventors: Vladimir Blecha, Aurora; Katherine M. McGuire, Clarendon Hills; Andrew J. Neuhalfen, Algonquin; Daniel B. Onken, Sheldon, all of Ill.

[73] Assignee: Littelfuse, Inc., Des Plaines, Ill.

[21] Appl. No.: 08/482,829

[22] Filed: Jun. 7, 1995

Related U.S. Application Data

[63] Continuation-in-part of application No. 08/247,584, May 27, 1994, Pat. No. 5,552,757.

[51] Int. Cl.[6] ..... H01H 69/02

[52] U.S. Cl. ..... 29/623; 29/874; 29/621; 337/297; 427/282; 427/123

[58] Field of Search ..... 29/623, 621, 619, 29/874; 427/282; 101/129; 337/222, 297

[56] References Cited

U.S. PATENT DOCUMENTS

| | | | |
|---|---|---|---|
| 3,619,725 | 11/1971 | Soden et al. | 317/101 A |
| 3,913,219 | 10/1975 | Lichtblau . | |
| 4,164,725 | 8/1979 | Wiebe | 337/198 |
| 4,198,744 | 4/1980 | Nicolay | 29/623 |
| 4,278,706 | 7/1981 | Barry | 29/621 |
| 4,503,415 | 3/1985 | Rooney et al. | 337/160 |
| 4,514,718 | 4/1985 | Birx | 337/407 |
| 4,533,896 | 8/1985 | Belopolsky | 337/232 |
| 4,540,969 | 9/1985 | Sugar | 337/232 |
| 4,547,830 | 10/1985 | Yamauchi | 361/104 |
| 4,554,732 | 11/1985 | Sadlo et al. | 29/620 |
| 4,612,529 | 9/1986 | Gurevich et al. | 337/255 |
| 4,626,818 | 12/1986 | Hilgers | 337/166 |

(List continued on next page.)

FOREIGN PATENT DOCUMENTS

| | | | |
|---|---|---|---|
| 0270954 A1 | 6/1988 | European Pat. Off. . | |
| A 270954 | 6/1988 | European Pat. Off. . | |
| 0 301 533 A2 | 7/1988 | European Pat. Off. . | |
| JA 0043701 | 2/1990 | European Pat. Off. . | |
| 0 453 217 A1 | 4/1991 | European Pat. Off. . | |
| 0 581 428 A1 | 6/1993 | European Pat. Off. . | |
| 0581428 A1 | 2/1994 | European Pat. Off. . | |
| 1803554 | 5/1969 | Germany . | |
| 3530354 A1 | 3/1987 | Germany . | |
| 3728489 A1 | 8/1987 | Germany . | |
| 2-43701 | 2/1990 | Japan | 29/623 |
| 04242036 | 1/1991 | Japan . | |
| 4-033230 | 2/1992 | Japan . | |
| 4033230 | 2/1992 | Japan . | |
| 4-245129 | 9/1992 | Japan . | |
| 4-245132 | 9/1992 | Japan . | |
| 4-248221 | 9/1992 | Japan . | |
| 4-254302 | 9/1992 | Japan | 29/610.1 |
| 4-255627 | 9/1992 | Japan . | |
| 4245129 | 9/1992 | Japan . | |
| 4245132 | 9/1992 | Japan . | |
| 4248221 | 9/1992 | Japan . | |
| 4255627 | 9/1992 | Japan . | |
| 5-166454 | 7/1993 | Japan . | |
| 5166454 | 7/1993 | Japan . | |
| 05314888 | 11/1993 | Japan . | |
| 06103880 | 4/1994 | Japan . | |
| 1 477 572 | 1/1975 | United Kingdom . | |
| 1604820 | 12/1981 | United Kingdom . | |
| 2089148 | 6/1982 | United Kingdom . | |
| WO 83/01153 | 3/1983 | WIPO . | |
| WO 90/00305 | 1/1990 | WIPO . | |
| WO 91/14279 | 9/1991 | WIPO . | |

*Primary Examiner*—P. W. Echols
*Attorney, Agent, or Firm*—Wallenstein & Wagner, Ltd.

[57] ABSTRACT

A thin film surface-mount fuse having two material subassemblies. The first subassembly includes a fusible link, its supporting substrate and terminal pads. The second subassembly includes a protective layer which overlies the fusible link so as to provide protection from impacts and oxidation. The protective layer is preferably made of a polymeric material. The most preferred polymeric material is a polyurethane gel or paste. In addition, the most preferred supporting substrate is an FR-4 epoxy or a polyimide.

12 Claims, 5 Drawing Sheets

U.S. PATENT DOCUMENTS

| | | | |
|---|---|---|---|
| 4,652,848 | 3/1987 | Hundrieser | 337/297 |
| 4,720,402 | 1/1988 | Wojcik | 427/282 |
| 4,726,991 | 2/1988 | Hyatt et al. | 428/329 |
| 4,771,260 | 9/1988 | Gurevich | 337/231 |
| 4,788,523 | 11/1988 | Robbins | 29/621 |
| 4,792,781 | 12/1988 | Takahashi et al. . | |
| 4,837,520 | 6/1989 | Golke | 324/550 |
| 4,873,506 | 10/1989 | Gurevich | 337/290 |
| 4,958,426 | 9/1990 | Endo et al. | 29/623 |
| 4,975,551 | 12/1990 | Syvertson | 200/144 |
| 4,977,357 | 12/1990 | Shrier . | |
| 5,084,691 | 1/1992 | Lester et al. | 337/297 |
| 5,095,297 | 3/1992 | Perreault et al. | 337/297 |
| 5,097,246 | 3/1992 | Cook et al. | 337/297 |
| 5,097,247 | 3/1992 | Doerrwaechter | 337/405 |
| 5,102,506 | 4/1992 | Tanielian et al. | 205/118 |
| 5,102,712 | 4/1992 | Peirce et al. . | |
| 5,115,220 | 5/1992 | Suuronen et al. | 337/297 |
| 5,140,295 | 8/1992 | Vermot-gaud et al. | 337/297 |
| 5,148,141 | 9/1992 | Suuronen | 337/297 |
| 5,155,462 | 10/1992 | Morrill, Jr. | 337/3 |
| 5,166,656 | 11/1992 | Badihi et al. | 337/297 |
| 5,232,758 | 8/1993 | Juskey et al. . | |
| 5,262,754 | 11/1993 | Collins | 338/21 |
| 5,340,775 | 8/1994 | Carruthers et al. | 437/246 |
| 5,363,082 | 11/1994 | Gurevich | 337/227 |
| 5,374,590 | 12/1994 | Batdorf et al. | 437/173 |
| 5,438,166 | 8/1995 | Carey et al. . | |
| 5,537,108 | 7/1996 | Nathan et al. . | |
| 5,592,016 | 1/1997 | Go et al. . | |

METHOD OF MANUFACTURING A SURFACE-MOUNTED FUSE DEVICE

RELATED APPLICATION

The present application is a continuation-in-part application of U.S. Ser. No. 08/247,584, filed May 27, 1994 now U.S. Pat. No. 5,552,757.

DESCRIPTION

TECHNICAL FIELD

The invention relates generally to a surface-mountable fuse for placement into and protection of the electrical circuit of a printed circuit board.

BACKGROUND OF THE INVENTION

Printed circuit (PC) boards have found increasing application in electrical and electronic equipment of all kinds. The electrical circuits formed on these PC boards, like larger scale, conventional electrical circuits, need protection against electrical overloads. This protection is typically provided by subminiature fuses that are physically secured to the PC board.

One example of such a subminiature, surface-mounted fuse is disclosed in U.S. Pat. No. 5,166,656 ('656 patent). The fusible link of this surface-mounted fuse is disclosed as being covered with a three layer composite which includes a passivation layer, an insulating cover, and an epoxy layer to bond the passivation layer to the insulating cover. See '656 patent, column 6, lines 4–7. Typically, the passivation layer is either chemically vapor-deposited silica or a thick layer of printed glass. See '656 patent, column 3, lines 39–41. The insulating cover may be a glass cover. See '656 patent, column 4, lines 43–46. The fuse from the '656 patent has three layers protecting its fusible link. In addition, the fuse from the '656 patent has relatively thick glass covering. There are several other features in the '656 patent fuse which are unnecessary in the present invention. Thus, the present invention is designed to solve these and other problems.

SUMMARY OF THE INVENTION

The invention is a thin film, surface-mounted fuse which comprises two material subassemblies. The first subassembly comprises a fusible link, its supporting substrate and terminal pads. The second subassembly comprises a protective layer which overlies the fusible link so as to provide protection from impacts and oxidation.

The protective layer is preferably made of a polymeric material. The most preferred polymeric material is a polyurethane gel or paste when the stencil printing step is used to apply the cover coat. However, polycarbonates will also work well when an injection molding step is used to apply the cover coat. In addition, the most preferred supporting substrate is an FR-4 epoxy or a polyimide.

A second aspect of the invention is a thin film, surface-mounted fuse. This fuse comprises a fusible link made of a conductive metal. The first conductive metal is preferably, but not exclusively, selected from the group including copper, silver, nickel, titanium, aluminum or alloys of these conductive metals. A second conductive metal, different from the first conductive metal, is deposited on the surface of this fusible link. One preferred metal for the surface-mounted fuse of this invention is copper. One preferred second conductive metal is tin-lead. Another preferred second conductive metal is tin.

The second conductive metal may be deposited onto the fusible link in the form of a rectangle, circle or in the form of any of several other configurations, depending on the configuration of the fuse link. The second conductive metal is preferably deposited along the central portion of the fusible link.

Photolithographic, mechanical and laser processing techniques may be employed to create very small, intricate and complex fusible link geometries. This capability, when combined with the extremely thin film coatings applied through electrochemical and physical vapor deposition (PVD) techniques, enables these subminiature fuses to control the fusible area of the element and protect circuits passing microampere- and ampere-range currents. This is unique, in that prior fuses providing protection at these high currents were made with filament wires. The manufacture of such filament wire fuses created certain difficulties in handling.

The location of the fusible link at the top of the substrate of the present fuse enables one to use laser processing methods as a high precision secondary operation, in that way trimming the final resistance value of the fuse element.

DETAILED DESCRIPTION OF THE PREFERRED EMBODIMENT

Figure 1:
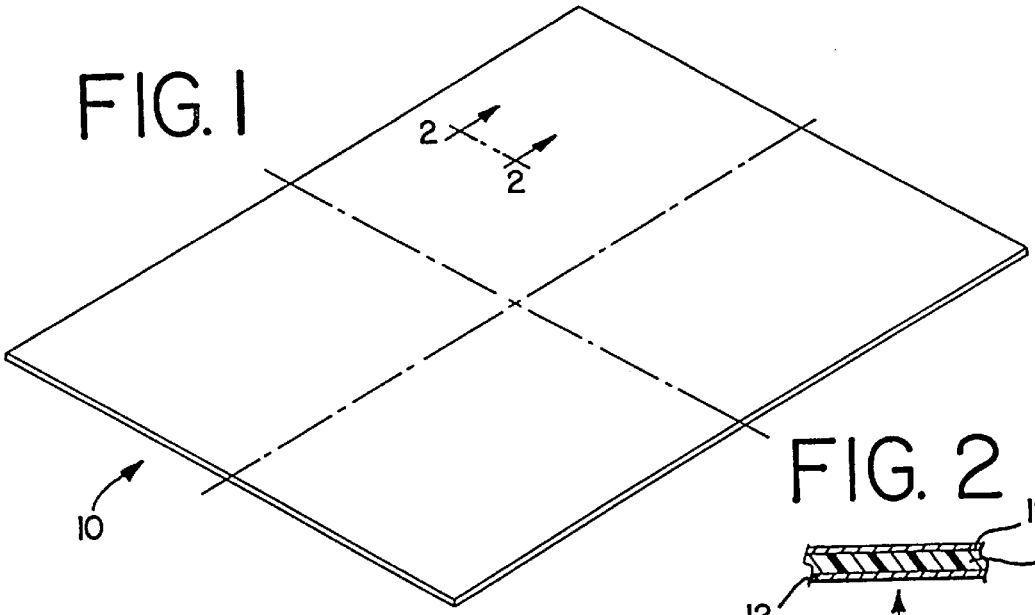
FIG. 1 is a perspective view of a copper-plated, FR-4 epoxy sheet used to make a subminiature surface-mounted fuse in accordance with the invention.

While this invention is susceptible of embodiment in many different forms, there is shown in the drawings and will herein be described in detail a preferred embodiment of the invention. It is to be understood that the present disclosure is to be considered as an exemplification of the principles of the invention. This disclosure is not intended to limit the broad aspect of the invention to the illustrated embodiment or embodiments.

Figure 12:
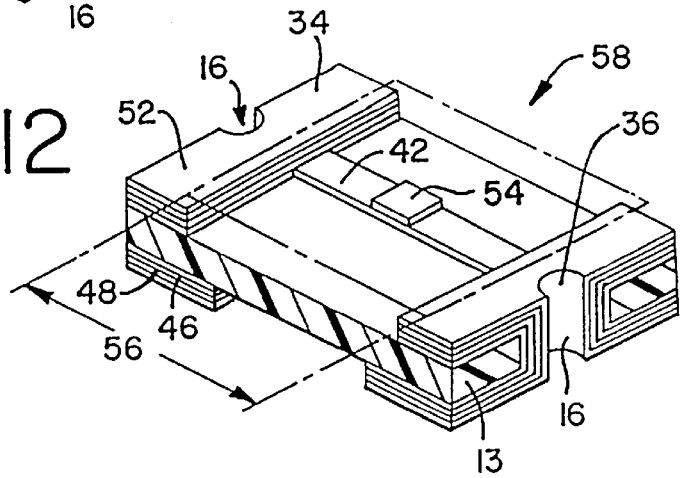
FIG. 12 shows the individual fuse in accordance with the invention as it is finally made, and after a so-called dicing operation in which a diamond saw is used to cut the strips along parallel and perpendicular planes to form these individual surface-mountable fuses.

One preferred embodiment of the present invention is shown in FIG. 12. The thin film, surface-mounted fuse is a subminiature fuse used in a surface mount configuration on a PC board or on a thick film hybrid circuit. One of these fuses is typically known in the art as an "A" case fuse. The "A" case fuse standard industry size for these fuses is 125 mils. long by 60 mils. wide. The "A" case fuse is also designated as a 1206 fuse. In addition, the present invention includes even smaller sized fuses which are compatible with standard sized surface mountable devices. In particular, the present invention can be used within all other standard sizes of such surface mountable device sizes, such as 1210, 0805, 0603 and 0402 fuses, as well as non-standard sizes.

The invention generally comprises two material subassemblies. Aa will be seen, the first subassembly includes the fuse element or fusible link 42, its supporting substrate or core 13, and terminal pads 34 and 36 for connecting the fuse 58 to the PC board. The second subassembly is a protective layer 56 which overlies the fusible link 42 and a substantial portion of the top portion of the fuse so as to, at least, provide protection from impacts which may occur during automated assembly, and protection from oxidation during use.

Figure 5:
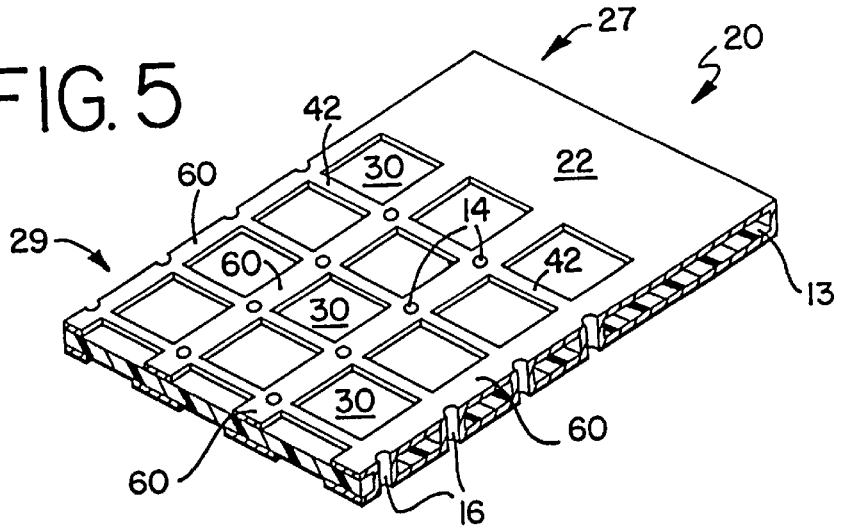
FIG. 5 is a cut-away perspective view of the flat, upward-facing surfaces of the replated copper sheet, after the sheet was masked with a multi-squared panel of an ultraviolet (UV) light-opaque substance.
Figure 6:
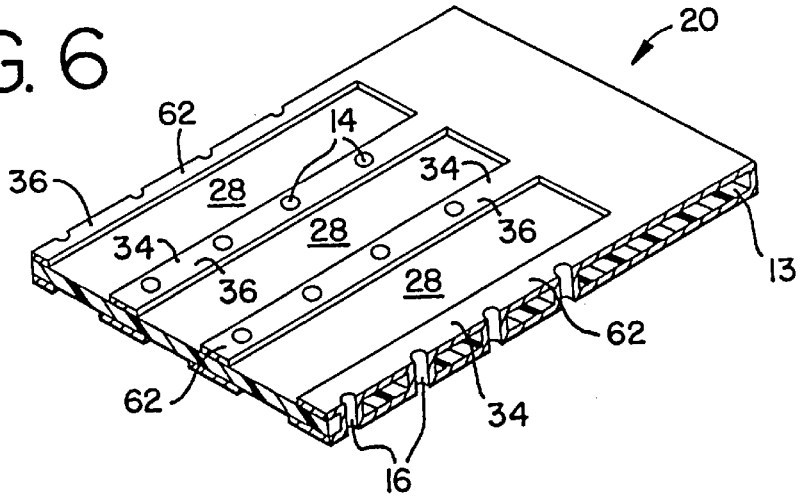
FIG. 6 is a perspective view of the reverse side of FIG. 5, rotated about one of the fuse rows 27, but after the removal of a strip-like portion of copper plating from the replated sheet of FIG. 5.

The first subassembly contains and supports two metal electrodes or pads 34, 36, and the fusible element or link 42, both of which are bonded to the substrate as a single continuous film, as shown in FIGS. 5 and 6. The pads 34, 36 are located on the top, the bottom, and a the sides of the substrate or core 13, while the fusible link 42 is located at the top of the substrate 13. More specifically, the pads 34, 36 extend into the two grooves 16 (each groove 16 is one half of each bore 14) in each fuse created by the bores 14 and dicing operation during the process of manufacture, as will be further described below.

As will be seen, in the preferred embodiment, pads are made up of several layers, including a base copper layer, a supplemental copper layer, a nickel layer and a tin-lead layer. The base copper layer of the pads and the thin film fusible link are simultaneously deposited by (1) electrochemical processes, such as the plating described in the preferred embodiment below; or (2) by PVD. Such simultaneous deposition ensures a good conductive path between the fusible link 42 and the terminal pads 34, 36. This type of deposition also facilitates manufacture, and permits very precise control of the thickness of the fusible link 42.

After initial placement of the fusible link 42 and the base copper onto the substrate 13, additional layers of a conductive metal are placed onto the terminal pads 34, 36. These additional layers could be defined and placed onto these pads by photolithography and deposition techniques, respectively.

Figure 2:
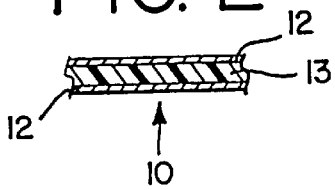
FIG. 2 is a view of a portion of the sheet of FIG. 1, and taken along lines 2—2 of FIG. 1.

This fuse may be made by the following process. Shown in FIGS. 1 and 2 is a solid sheet 10 of an FR-4 epoxy with copper plating 12. The copper plating 12 and the FR-4 epoxy core 13 of this solid sheet 10 may best be seen in FIG. 2. This copper-plated FR-4 epoxy sheet 10 is available from Allied Signal Laminate Systems, Hoosick Falls, N.Y., as Part No. 0200BED130C1/C1GFN0200C1/C1A2C. Although FR4 epoxy is a preferred material, other suitable materials include any material that is compatible with, i.e., of a chemically, physically and structurally similar nature to, the materials from which PC boards are made. Thus, another suitable material for this solid sheet 10 is polyimide. FR-4 epoxy and polyimide are among the class of materials having physical properties that are nearly identical with the standard substrate material used in the PC board industry. As a result, the fuse of the invention and the PC board to which that fuse is secured have extremely well-matched thermal and mechanical properties. The substrate of the fuse of the present invention also provides desired arc-tracking characteristics, and simultaneously exhibits sufficient mechanical flexibility to remain intact when exposed to the rapid release of energy associated with arcing.

In the next step of the process of manufacturing the fuses of the present invention, the copper plating 12 is etched away from the solid sheet 10 by a conventional etching process. In this conventional etching process, the copper is etched away from the substrate by a ferric chloride solution.

Although it will be understood that after completion of this step, all of the copper layer 12 of FIG. 2 is etched away from FR-4 epoxy core 13 of this solid sheet 10, the remaining epoxy core 13 of this FR-4 epoxy sheet 10 is different from a "clean" sheet of FR-4 epoxy that had not initially been treated with a copper layer. In particular, a chemically etched surface treatment remains on the surface of the epoxy core 13 after the copper layer 12 has been removed by etching. This treated surface of the epoxy core 13 is more receptive to subsequent operations that are necessary in the manufacture of the present surface-mounted subminiature fuse.

Figure 3:
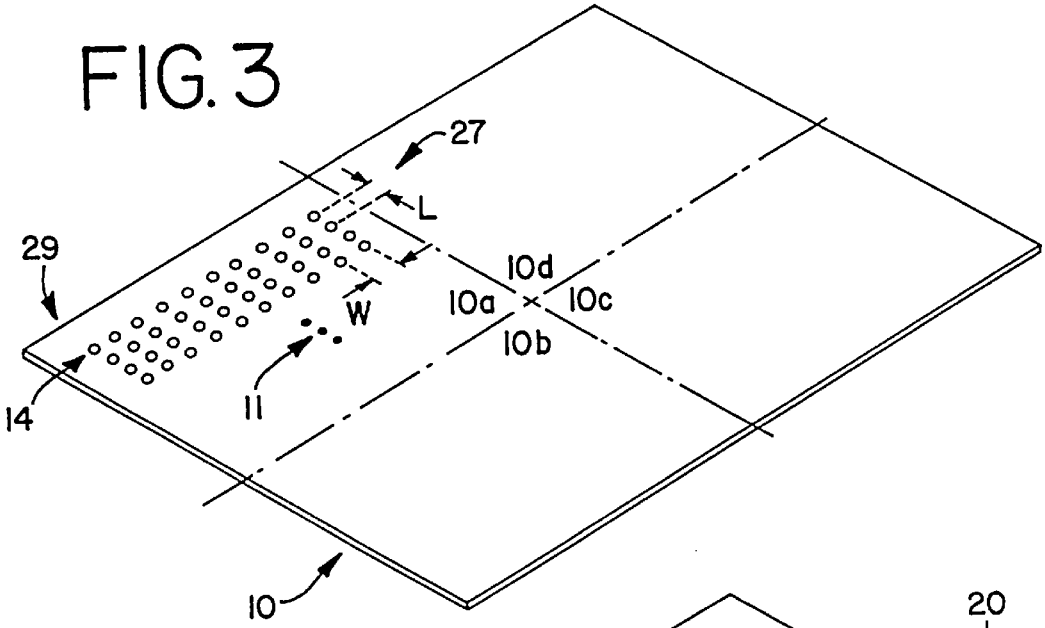
FIG. 3 is a perspective view of the FR-4 epoxy sheet of FIG. 1, but stripped of its copper plating, and with a plurality of bores (partially shown), each having a diameter D, spaced apart by a length L and a width W, and routed into separate quadrants of that sheet.

The FR-4 epoxy sheet 10 having this treated, copper-free surface is then drilled or punched to create holes or bores 14 along four quadrants 10*a*, 10*b*, 10*c*, 10*d* of the sheet 10, as may be seen in FIG. 3. Broken lines visually separate these four quadrants 10*a*, 10*b*, 10*c*, 10*d* in FIG. 3. It should be further noted that in FIG. 3, the bores 14 are lined up into rows 27 and columns 29. Although only four rows 27 of bores 14 are shown in FIG. 3 in one quadrant 10*a* for convenience, the rows 27 of holes 14 are actually disposed over almost the entire sheet 10 in all four quadrants 10*a*, 10*b*, 10*c*, 10*d*, as is designated by the three dots 11. For the "603" standard sizing of surface mounted devices mentioned above, the length L between the center of the bores 14 is approximately 70 mils, and the width W between the center of the bores 14 is approximately 38 mils. For the "402" standard sizing of surface mounted devices mentioned above, the length L between the center of the bores 14 is approximately 50 mils, and the width W between the center of the bores 14 is approximately 30 mils. Again, smaller and larger standard and non-standard sizings are possible for the present invention. The diameter D (FIG. 4) for each bore 14 for the "603" sizing is approximately 18 mils.

When the drilling or punching of the bores 14 has been completed, the etched and bored sheet 10 shown in FIG. 3 is again plated with copper. This reapplication of copper occurs through the immersion of the etched and bored sheet of FIG. 3 into an electroless copper plating bath. This method of copper plating is well-known in the art.

This copper plating step results in the placement of a copper layer having a uniform thickness along each of the exposed surfaces of the sheet 10. For example, as may be seen in FIG. 4, the copper plating 18 resulting from this step covers both (1) the flat, upper surfaces 22 of the sheet 10; and (2) the vertical regions of the groves 16 and/or the vertical regions of the bores 14. These vertical portions of the grooves 16 and/or bores 14 must be copper-plated because they will ultimately form a portion of the terminal pads 34, 36 of the final fuse as will be further described below.

The uniform thickness of the copper plating will depend upon the ultimate needs of the user. Particularly, as may be seen in FIG. 4, for a fuse intended to open at 1/16 ampere, the copper plating 18 has a thickness of 2,500 Angstroms. For a fuse intended to open at 5 amperes, the copper plating 18 has a thickness of approximately 75,000 Angstroms for a particular width of the fusable link.

Figure 4:
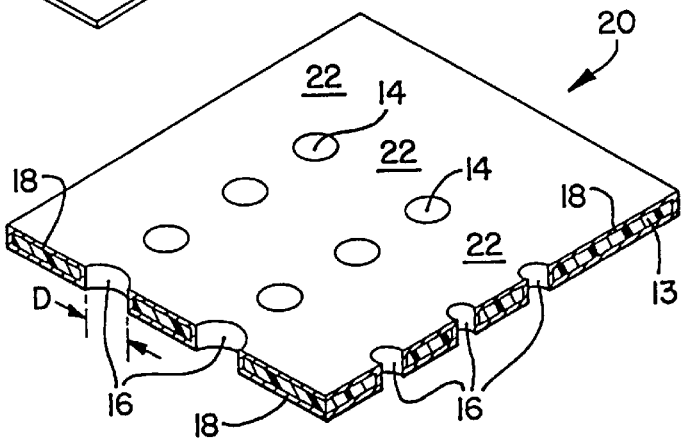
FIG. 4 is an enlarged, perspective view of a cut-away portion of the bored sheet of FIG. 3, but with a copper plating layer having been reapplied.

After plating has been completed, to arrive at the copper-plated structure of FIG. 4, the entire exposed surface of this structure is covered with a so-called photoresist polymer.

An otherwise clear mask is placed over the replated copper sheet 20 from FIG. 4 after it has been covered with the photoresist. Square panels are a part of, and are evenly spaced across, this clear mask according to the sizing of the fuse being manufactured. These square panels are made of an UV light-opaque substance, and are generally shown as the rectangle 30 shown in FIG. 5. Essentially, by placing this mask having these panels onto the replated copper sheet 20, several portions of the flat, upward-facing surfaces 22 of the replated copper sheet 20 from FIG. 4. are effectively shielded from the effects of UV light.

It will be understood from the following discussion that these square panels will essentially define the shapes and sizes of the so-called fusible link 42 and the upper terminal areas 60 of the terminal pads 34, 36 on the upper portion 22 of the fuse. The fusible link 42 is in electrical communication with the upper terminal areas 60. It will be appreciated that the width, length and shape of both the fusible link 42 and these upper terminal areas 60 may be altered by changing the size and shape of these UV light-opaque panels.

Additionally, the backside of the sheet is covered with a photoresist material and an otherwise clear mask is placed over the replated copper sheet 20 after it has been covered with the photoresist. A rectangular panel is a part of this clear mask. The rectangular panels are made of a UV light-opaque substance, and are of a size corresponding to the size of the panel 28 shown in FIG. 6. Essentially, by placing this mask having these panels onto the replated copper sheet 20, several strips of the flat, downward-facing surfaces 28 of the replated copper sheet 20 are effectively shielded from the effects of the UV light. The rectangular panels will essentially define the shapes and sizes of the lower terminal areas 62 of the terminal pads 34, 36, and the lower middle portions 28 of sheet 20, as shown in FIG. 6.

The copper plating from a portion of the underside of a sheet 20 is defined by a photoresist mask. Particularly, the copper plating from the lower, middle portions 28 of the underside of the sheet 20 is removed. The lower, middle portions 28 of the underside of the sheet 20 is that part of the strip along a line immediately beneath the areas 30 of clear epoxy, and the fuse links 42. A perspective view of this section of this replated sheet 20 is shown in FIG. 6.

The entire replated, photoresist-covered sheet 20, i.e., the top, bottom and sides of that sheet, is then subjected to UV light. The replated sheet 20 is subjected to the UV light for a time sufficient to ensure curing of all of the photoresist that is not covered by the square panels and rectangular strips of the masks. Thereafter, the masks containing these square panels and rectangular strips are removed from the replated sheet 20. The photoresist that was formerly below these square panels remains uncured. This uncured photoresist may be washed from the replated sheet 20 using a solvent.

The cured photoresist on the remainder of the replated sheet 20 provides protection against the next step in the process. Particularly, the cured photoresist prevents the removal of copper beneath those areas of cured photoresist. The regions formerly below the square panels have no cured photoresist and no such protection. Thus, the copper from those regions can be removed by etching. This etching is performed with a ferric chloride solution through well known etching concepts.

After the copper has been removed, as may be seen in FIGS. 5 and 6, the regions formerly below the square panels and the rectangular strips of the mask are not covered at all. Rather, those regions now comprise areas 28 and 30 of clear epoxy.

The replated sheet 20 is then placed in a chemical bath to remove all of the remaining cured photoresist from the previously cured areas of that sheet 20.

Figure 7:
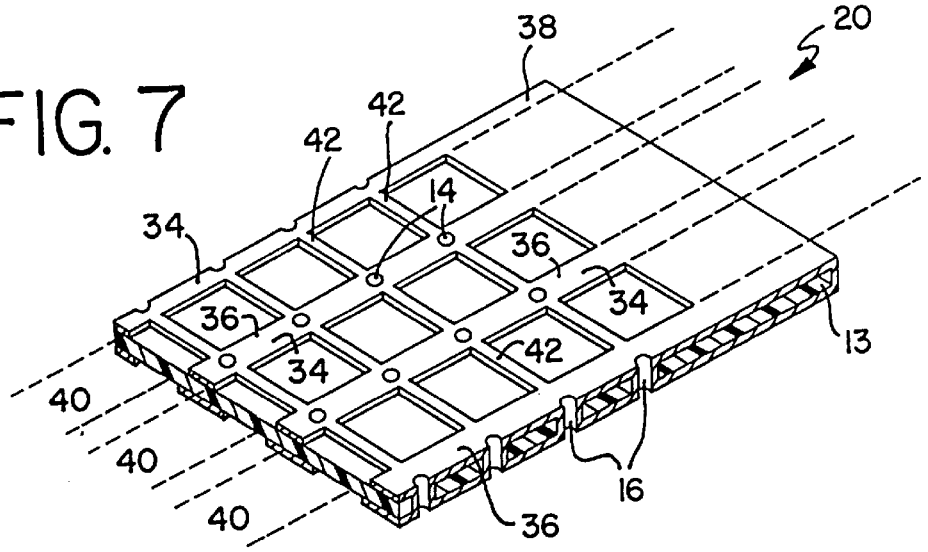
FIG. 7 is a perspective view of the top-side of FIG. 6, rotated about one of the fuse rows 27, and showing linear regions 40 defined by dotted lines.

After completion of several of the operations described in this specification, this sheet 20 will ultimately be cut into a plurality of pieces, and each of these pieces becomes a fuse in accordance with the invention, as will be further described below. However, for the purpose of brevity, only a cut-away portion of the overall sheet including three rows 27 and four columns 29 is shown in FIGS. 5 through 7. As may also be seen from FIG. 5 through 7, the bores 14 and grooves of the sheet 20 still include copper plating. These bores 14 and grooves 16 form portions of the pads 34, 36. These pads 34, 36 will ultimately serve as the means for securing the entire, finished fuse to the PC board.

FIG. 7 is a perspective view of the opposite side of the sheet 20 from FIG. 6. Directly opposite and coinciding with the lower, middle portions 28 of the sheet 20 are linear regions 40 on the top-side 38 of the sheet 20. These linear regions 40 are defined by the dotted lines of FIG. 7.

FIG. 7 is to be referred to in connection with the next step in the manufacture of the invention. In this next step, a photoresist polymer is placed along each of the linear regions 40 of the top side 38 of the sheet 20. Through the covering of these linear regions 40, photoresist polymer is also placed along the relatively thin portions which will comprise the fusible links 42. These fusible links 42 are made of a conductive metal, here copper. The photoresist polymer is then treated with UV light, resulting in a curing of the polymer onto linear region 40 and its fusible links 42.

As a result of the curing of this photoresist onto the linear region 40 and its fusible links 42, metal will not adhere to this linear region 40 when the sheet 20 is dipped into an electrolytic bath containing a metal for plating purposes.

In addition, as explained above, the middle portion 28 of the underside of the sheet 20 will also not be subject to plating when the sheet 20 is dipped into the electrolytic plating bath. Copper metal previously covering this metal portion had been removed, revealing the bare epoxy that forms the base of the sheet 20. Metal will not adhere to or plate onto this bare epoxy using an electrolytic plating process.

The entire sheet 20 is dipped into an electrolytic copper plating bath and then an electrolytic nickel plating bath. As a result, as may be seen in FIG. 8, a copper layer 46 and a nickel layer 48 are deposited on the base copper layer 44. After deposition of these copper 46 and nickel layers 48, the cured photoresist polymer on the linear region 40, including the photoresist polymer on the fusible links 42, is removed from that region 40.

Photoresist polymer is then immediately reapplied along the entire linear region 40. As may be seen in FIG. 9, however, a portion 50 at the center of the fusible link 42 is masked with a UV light-opaque substance. The entire linear region 40 is then subjected to UV light, with the result that curing of the photoresist polymer occurs on all of that region, except for the masked central portion 50 of the fusible link 42. The mask is removed from the central portion 50 of the fusible link, and the sheet 20 is rinsed. As a result of this rinsing, the uncured photoresist above the central portion 50 of the fusible link 42 is removed from the fusible link 42. The cured photoresist along the remainder of the linear region 40, however, remains.

Plating of metal will not occur on the portion of the sheet 20 covered by the cured photoresist. Because of the absence of the photoresist from the central portion 50 of the fusible link 42, however, metal may be plated onto this central portion 50.

Figure 9:
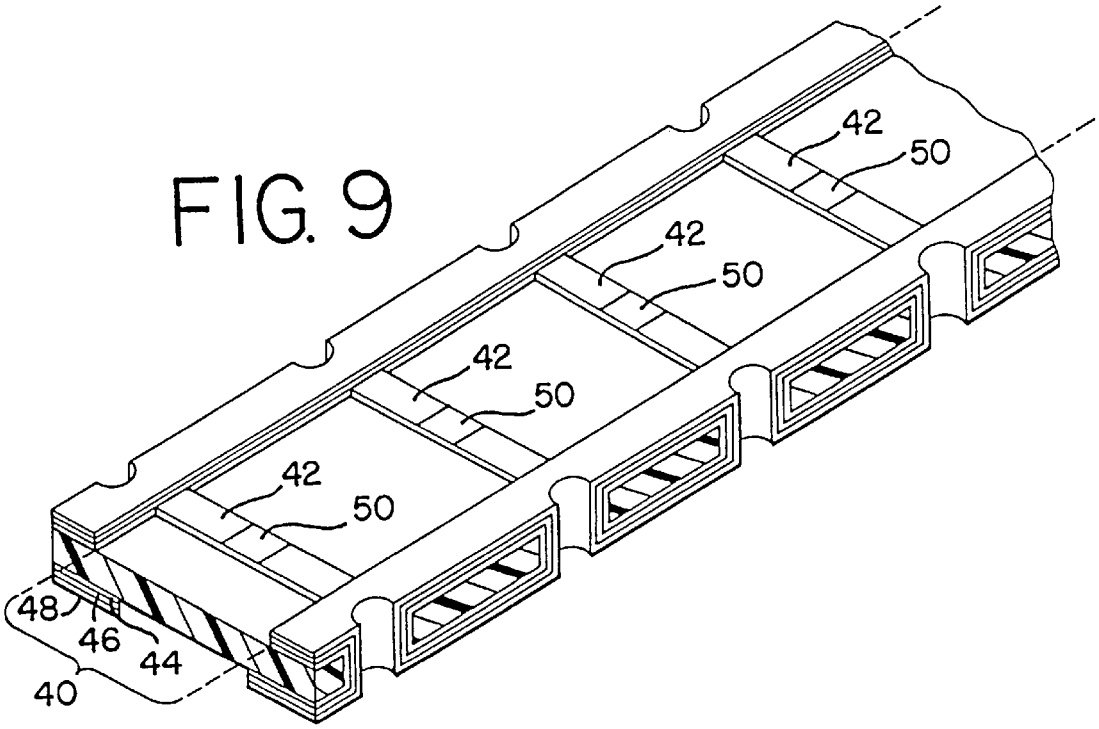
FIG. 9 is a perspective view of the strip of FIG. 8, but prior to UV light curing, and showing a fuse-blowing portion 50 at the center of fusible link 42 that is masked with a UV light-opaque substance.
Figure 10:
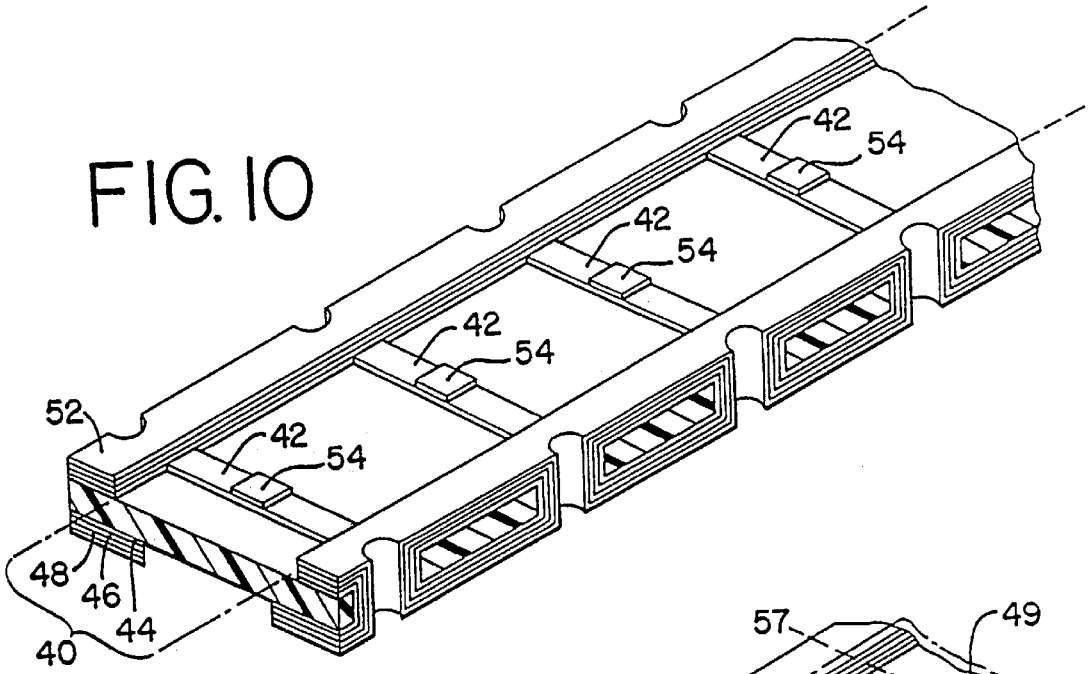
FIG. 10 shows the strip of FIG. 9, but after immersion into a tin-lead plating bath to create another layer over the copper and nickel layers, and after deposition of a tin-lead alloy onto the central portion of the fusible link.

When the strip shown in FIG. 9 is dipped into an electrolytic tin-lead plating bath, a tin-lead layer 52 (FIG. 10) is overlain over the copper 46 and nickel layers 48. A tin-lead spot 54 is also deposited onto the surface of the fusible link 42, i.e., essentially placed by an electrolytic plating process onto the central portion 50 of the fusible link 42. This electrolytic plating process is essentially a thin film deposition process. It will be understood, however, that this tin-lead may also be added to the surface of the fusible link 42 by a photolithographic process or by means of a physical vapor deposition process, such as sputtering or evaporation in a high vacuum deposition chamber.

This spot 54 is comprised of a second conductive metal, i.e., tin-lead or tin, that is dissimilar to the copper metal of the fusible link 42. This second conductive metal in the form of the tin-lead spot 54 is deposited onto the fusible link 42 in the form of a rectangle.

The tin-lead spot 54 on the fusible link 42 provides that link 42 with certain advantages. First, the tin-lead spot 54 melts upon current overload conditions, creating a fusible link 42 that becomes a tin-lead-copper alloy. This tin-lead-copper alloy results in a fusible link 42 having a lower melting temperature than the copper alone. The lower melting temperature reduces the operating temperature of the fuse device of the invention, and this results in improved performance of the device.

Although a tin-lead alloy is deposited on the copper fusible link 42 in this example, it will be understood by those skilled in the art that other conductive metals may be placed on the fusible link 42 to lower its melting temperature, and that the fusible link 42 itself may be made of conductive metals other than copper. In addition, the tin-lead alloy or other metal deposited on the fusible link 42 need not be of a rectangular shape, but can take on any number of additional configurations.

The second conductive metal may be placed in a notched section of the link, or in holes or voids in that link. Parallel fuse links are also possible. As a result of this flexibility, specific electrical characteristics can be engineered into the fuse to meet varying needs of the ultimate user.

As indicated above, one of the possible fusible link configurations is a serpentine configuration. By using a serpentine configuration, the effective length of the fusible link may be increased, even though the distance between the terminals at the opposite ends of that link remain the same. In this way, a serpentine configuration provides for a longer fusible link without increasing the dimensions of the fuse itself.

Figure 11:
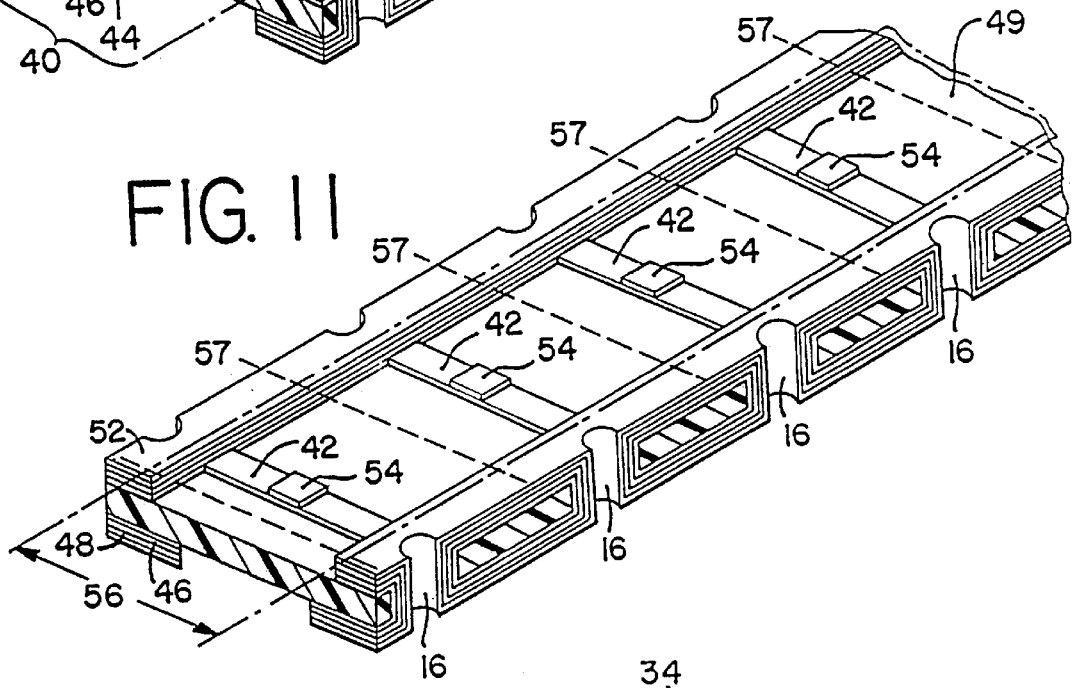
FIG. 11 shows the strip of FIG. 10, but with an added polymeric gel or paste layer onto the top of the fuse row 27.

The next step in the manufacture of the device of the invention is the placement, across a significant portion of the top of the sheet 20 between the terminal pads 34, 36, of a protective layer 56 (FIG. 11). This protective layer 56 is the second subassembly of the present fuse, and forms a relatively tight seal over the portion of the top of the sheet where the fusible links 42 exist. In this way, the protective layer 56 inhibits corrosion of the fusible links 42 during their useful lives. The protective layer 56 also provides protection from oxidation and impacts during attachment to the PC board. This protective layer also serves as a means of providing for a surface for pick and place operations which use a vacuum pick-up tool.

This protective layer 56 helps to control the melting, ionization and arcing which occur in the fusible link 42 during current overload conditions. The protective layer 56 or cover coat material provides desired arc-quenching characteristics, especially important upon interruption of the fusible link 42.

The protective layer 56 may be comprised of a polymer, preferably a polyurethane gel or paste when a stencil print operation is used to apply the cover coat. A preferred polyurethane is made by Dymax Corporation. Other similar gels, pastes, or adhesives are suitable for the invention. In addition to polymers, the protective layer 56 may also be comprised of plastics, conformal coatings and epoxies.

Figure 13:
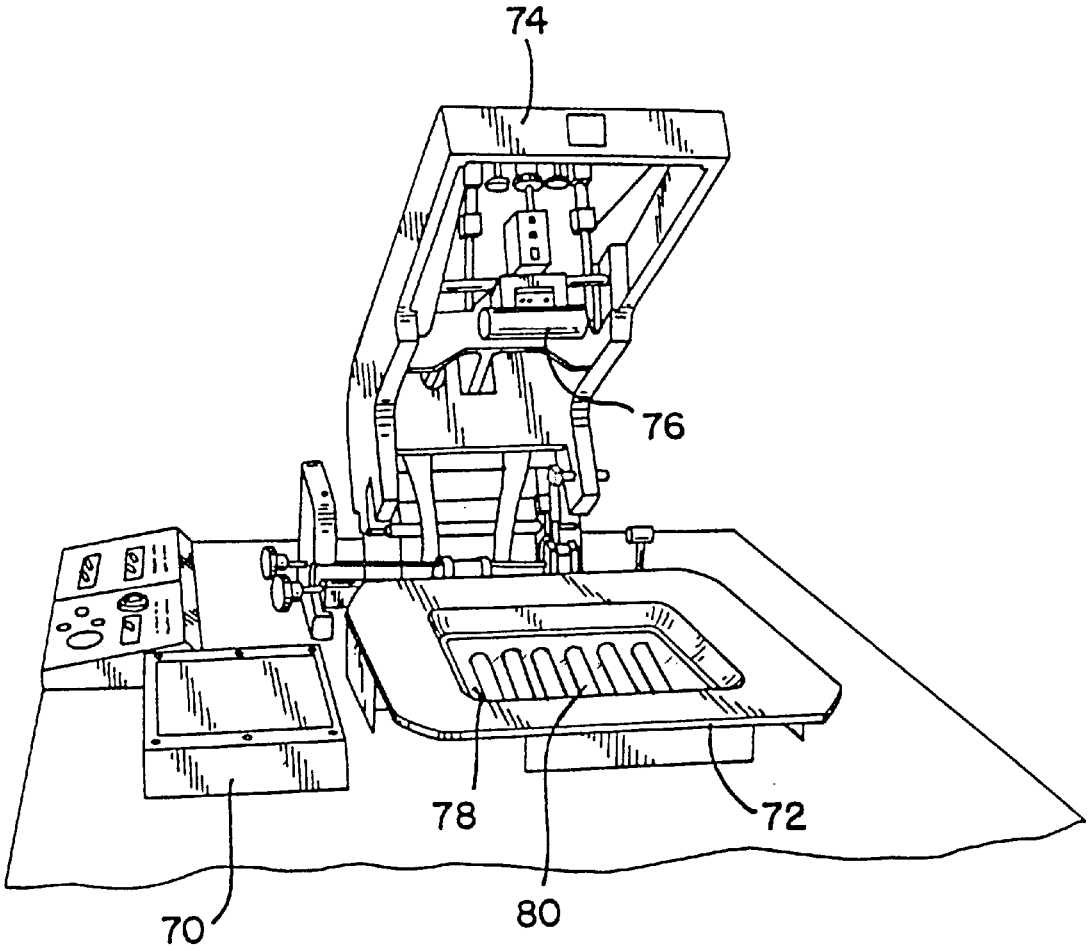
FIG. 13 is a front view of a conventional stencil printing machine.

This protective layer 56 is applied to the strips 26 using a stencil printing process which includes the use of a common stencil printing machine, as shown in FIG. 13. In the past, an injection of the material into a die mold was performed while the sheet 20 was clamped between two dies. However, stencil printing is a much faster process. Specifically, it has been found that the use of a stencil printing process while using a stencil printing machine, at least, doubles production output of the number of fuses from a previous die mold operation. The stencil printing machine is made by Affiliated Manufacturers, Inc, of Northbranch, N.J., Model No. CP-885.

In the stencil printing process, the material is applied to the sheet 20 in strips simultaneously, instead of two strips at a time in the die mold/injection filling process. As will be further explained below, the material is cured much faster than the injection fill process because in the stencil printing process, the cover coat material is completely exposed to the UV radiation from the lamps as opposed to the injection filling process where a filter is used through which energy is transmitted from the lamp to the coating itself because the mold itself acts as a filter. Furthermore, the stencil printing process produces a more uniform cover coat than the injection filling process, in terms of the height, the width of the cover coat. Because of that uniformity, the fuses can be tested and packaged automatically. With the injection filling process it was sometimes difficult to precisely align the fuses in testing and packaging equipment due to some non-uniform heights and widths of the cover coat.

The stencil printing machine comprises a slidable plate 70, a base 72, a squeegee arm 74, a squeegee 76, and an overlay 78. The overlay 78 is mounted on the base 72 and the squeegee 76 is movably mounted on the squeegee arm 74 above the base 72 and overlay 78. The plate 70 is slidable underneath the base 72 and overlay 78. The overlay 78 has parallel openings 80 which correspond to the width of the cover coat 56.

Figure 8:
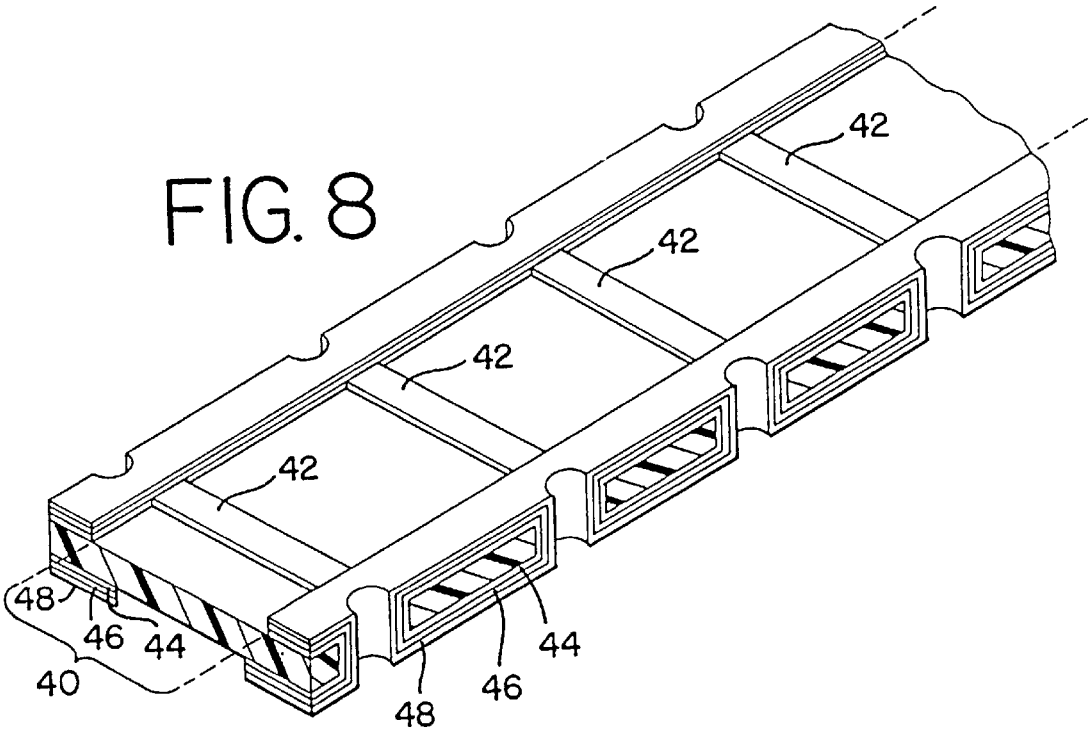
FIG. 8 is a perspective view of a single fuse row 27 from the sheet, cut away from the other fuse rows, and cut away at one edge of one of the fuses, after dipping the sheet into a copper plating bath and then a nickel plating bath, with the result that copper and nickel layers are deposited onto the base copper layer of the terminal pads, including the grooves of the pads.

The stencil printing process begins by attaching an adhesive tape under the fuse sheet 20. The fuse sheet 20, with the adhesive tape, is placed on the plate 70 with the adhesive tape between the plate 70 and the fuse sheet 20. The cover coat material is then applied with a syringe at one end of the overlay 78. The plate 70 then slides underneath the overlay 78 and lodges the sheet 20 underneath the overlay 78 in correct alignment with the parallel openings 80. The squeegee 76 then lowers to contact the overlay 78 beyond the material on the top of the overlay 78. The squeegee 76 then moves across the overlay 78 where the openings 80 exist, thereby forcing the cover coat material through the openings 80 and onto the sheet. Thus, the cover coat now covers the fuse link area 40 (FIGS. 8 & 9). The squeegee 76 is then raised, the sheet 20 is unlodged from the overlay 78, and the sheet 20 is placed in a UV light chamber so that the material can solidify and form the protective layer 56 (FIGS. 11 & 12). The openings 80 in the overlay 78 are wide enough so that the protective layer partially overlaps the pads 34, 36, as shown in FIGS. 11 & 12. In addition, the material used for the cover coat should have a viscosity in the gel or paste range so that after the material is spread onto the sheet 20, it will flow in a manner which creates a generally flat top surface 49, but not flow into the holes 14 or groves 16.

Although a colorless, clear cover coat is aesthetically pleasing, alternative types of cover coats may be used. For example, colored, clear materials may be used. These colored materials may be simply manufactured by the addition of a dye to a clear polyurethane gel or paste. Color coding may be accomplished through the use of these colored gels and pastes. In other words, different colors of gels can correspond to different amperages, providing the user with a ready means of determining the amperage of any given fuse. The transparency of both of these coatings permit the user to visually inspect the fusible link 42 prior to installation, and during use, in the electronic device in which the fuse is used.

The use of this protective layer 56 has significant advantages over the prior art, including the prior art, so-called, "capping" method. Due to the placement of the protective layer 56 over the entire top of a fuse body, the location of the protective layer relative to the location of the fusible link 42 is not critical.

The sheet 20 is then ready for a so-called dicing operation, which separates the rows and columns 27, 29 from one another, and into individual fuses. In this dicing operation, a diamond saw or the like is used to cut the sheet 20 along parallel planes 57 (FIG. 11), and again perpendicular to planes 57, through the center of the holes 14, into individual thin film surface-mounted fuses 58 0(FIG. 12). One of the directions of cuts bisect the terminal areas through the center of the holes 14, thereby exposing and creating the grooves 16 of the terminal pads 34, 36. These grooves 16 appear on either side of the fusible link 42.

This cutting operation completes the manufacture of the thin film surface-mounted fuse 58 (FIG. 12) of the present invention.

Fuses in accordance with this invention are rated at voltages and amperages greater than the ratings of prior art devices. Tests have indicated that fuses which fall under the "603" standard sizing would have a fuse voltage rating of 32 volts AC, and a fuse amperage rating of between 1/16 ampere and 2 amperes. Even though the fuses in accordance with this invention can protect circuits over a broad range of amperage ratings, the actual physical size of these fuses remains constant.

In summary, the fuse of the present invention exhibits improved control of fusing characteristics by regulating voltage drops across the fusible link 42. Consistent clearing times are ensured by (1) the ability to control, through deposition and photolithography processes, the dimensions and shapes of the fusible link 42 and terminal pads 34, 36; and (2) proper selection of the materials of the fusible link 42. Restriking tendencies are minimized by selection of an optimized material for the substrate 13 and protective layer 56.

While the specific embodiments have been illustrated and described, numerous modifications come to mind without significantly departing from the spirit of the invention, and the scope of protection is only limited by the scope of the accompanying claims.

What is claimed is:

1. A method for the manufacture of a thin film surface-mount fuse comprising the steps of:

a. providing a substrate having a top, a bottom and opposing sides, the opposing sides each having a groove therein;

b. depositing, upon the top of the substrate, a first conductive layer to simultaneously form a fusible link and terminal pads at opposite ends of the fusible link, the fusible link and terminal pads being electrically connected; and, c. applying a protective layer, wherein the protective layer is a layer of polymeric material which is applied as a gel and is smoothed across the upper surface of the supporting substrate and the fuse link to provide the polymeric material with a substantially flat upper surface.

2. The method as set forth in claim 1, wherein the first conductive layer extends from the top of the substrate and is deposited upon a portion of the sides of the substrate so that the terminal pads extend from the top of the substrate to a portion of the sides of the substrate.

3. The method of claim 2, wherein the first conductive layer is deposited in the grooves of the sides of the substrate so that the terminal pads are in the grooves of the substrate.

4. The method of claim 2, wherein the first conductive layer extends from the sides of the substrate and is deposited on a portion of the bottom of the substrate so that the terminal pads extend onto a portion of the bottom of the substrate.

5. The method as set forth in claim 1, wherein the first conductive layer which forms said fusible link and terminal pads is deposited by vapor deposition.

6. The method as set forth in claim 1, wherein the first conductive layer which forms said fusible link and terminal pads is electrochemically deposited.

7. A method of manufacturing a thin film surface-mount fuse comprising the steps of:

a. providing a substrate having an upper surface, a lower surface and a pair of bores;

b. depositing a first conductive layer on the upper surface of the substrate to simultaneously form a fusible link and terminal pads on the upper surface of the substrate, the fusible link being deposited between the pair of bores and being electrically connected to the terminal pads; and, c. applying a protective layer, wherein the protective layer includes a single layer of polymeric material which is applied as a gel and is smoothed across the upper surface of the supporting substrate and the fuse link to provide a substantially flat upper surface when the polymeric material hardens.

8. The method of claim 7, wherein the first conductive layer extends from the upper surface of the substrate into the bores so that the terminal pads extend from the upper surface into the bores.

9. The method of claim 8, wherein the first conductive layer extends from the bores and terminates on the lower surface of the substrate so that the terminal pads extend from the bores and terminate on the lower surface of the substrate.

10. The method of claim 9, further including the step of depositing one or more additional conductive layers on top of the terminal pads.

11. The method of claim 7, further including the step of deposition a metallic spot onto the fusible link.

12. The method of claim 7, wherein the protective layer is applied to the fusible link using a stencil printing machine.

* * * * *